United States Patent [19]

Dorris

[11] Patent Number: 4,759,096

[45] Date of Patent: Jul. 26, 1988

[54] CARPET FASTENER

[76] Inventor: Marvin Dorris, P.O. Box 361, Coweta, Okla. 74429

[21] Appl. No.: 74,362

[22] Filed: Jul. 16, 1987

[51] Int. Cl.[4] ..... A47G 27/04

[52] U.S. Cl. ..... 16/4; 16/6; 16/7; 16/8; 16/16

[58] Field of Search ..... 16/4, 6, 7, 8, 16

[56] References Cited

U.S. PATENT DOCUMENTS

| | | | |
|---|---|---|---|
| 1,847,373 | 3/1932 | Awbrey | 16/7 |
| 2,211,574 | 8/1940 | McNicholas | 16/6 |
| 2,990,565 | 7/1961 | Atwood | 16/16 |
| 3,564,642 | 2/1971 | Blackburn | 16/7 |

*Primary Examiner*—Nicholas P. Godici
*Assistant Examiner*—Edward Brown

[57] ABSTRACT

The present invention is a carpet fastener for securing an edge of an expanse of carpet against a vertical surface having a face board secured thereto. The fastener includes a carpet retaining portion and a face board engaging portion. During installation, the face board engaging portion is inserted into a gap formed between the floor surface and the underside of the face board. Protrusions on the face board engaging portion rigidly secure the fastener so that nails or glue are not required.

9 Claims, 2 Drawing Sheets

CARPET FASTENER

BACKGROUND OF THE INVENTION

1. Field of the Invention

The present invention relates to a carpet fastener and, more particularly, to such a carpet fastener that is secured against a vertical planar surface without glue or nails.

2. Description of the Prior Art

As is well known in the art, carpet laying is a tedious job, especially in the securing of the carpet edges to the floor. Almost universally, all residential and commercial carpet applications use a tack strip that is glued and/or nailed to the floor. The tack strip generally is a length of wood that has spaced tacks extending out therefrom. When laying the carpet, the carpet edge is folded over to hide the carpet backing and stretched across and held by the spaced tacks.

One of the most tedious operations in carpet laying is having to cut lengths of tack strip to be laid around or across door openings, and in corners. These lengths vary in size and shape so that each doorway and corner is customed-fit. This operation is time consuming. Further, each tack strip must be nailed to the floor for installation, but if carpet is laid on a cement slab, nail/-screw holes have to be drilled in the cement or glue is used. The drilling of nail/screw holes and using glue is likewise time consuming. Further, the inhalation of the glue vapors should be avoided.

There is a need for a simple carpet fastener and method of installation that does not require custom fitting and does not require nails or glue for installation.

SUMMARY OF THE INVENTION

The present invention meets the above described needs and overcomes the foregoing deficiencies. The present invention generally comprises a carpet fastener adaptable for securing an edge of an expanse of carpet against a vertical surface, such as a wall or doorway casing, that includes a face-board.

The fastener has a body with a face board engaging portion to be inserted into a gap formed between the floor and an underside of the face board. Angled protrusions are included to rigidly retain the tack strip against the face board so that no nails or glue are required for its installation.

The fastener also includes, as part of the body, a carpet retaining portion for having the carpet edge affixed thereto at least substantially perpendicular to the floor surface.

DETAILED DESCRIPTION OF THE PREFERRED EMBODIMENTS

Figure 1:
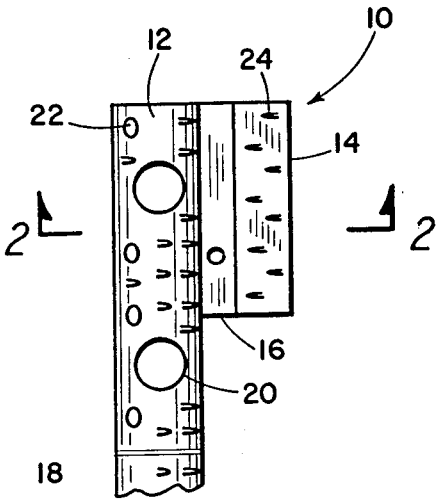
FIG. 1 is an overhead view of a carpet fastener embodying the present invention.

The present invention is a carpet fastener that engages the underside of a face board to secure an edge of an expanse of carpet. As shown in FIG. 1, the fastener generally comprises an elongated body 10 that is formed from wood, plastic, metal, flexable ceramic material, or combinations of these. The body 10 is formed by extrusion, stamping, pull-trusion, molding or assembling as desired.

Specifically, the body 10 includes a carpet retaining portion 12, a face board engaging portion 14, and an inclined or flat plateau portion 16 therebetween. The carpet retaining portion 12 can include a plurality of lateral cutting indentations 18 that ease the force required to cut the body 10 to a desired length. Material saving openings 20 can be included, as well as tack/nail openings 22, if desired. Several types of carpet retaining devices can be used alone or in combination. Such carpet retaining devices include glue, tacks, protrusions, and preferably inclined spikes or nails 24.

Figure 2:
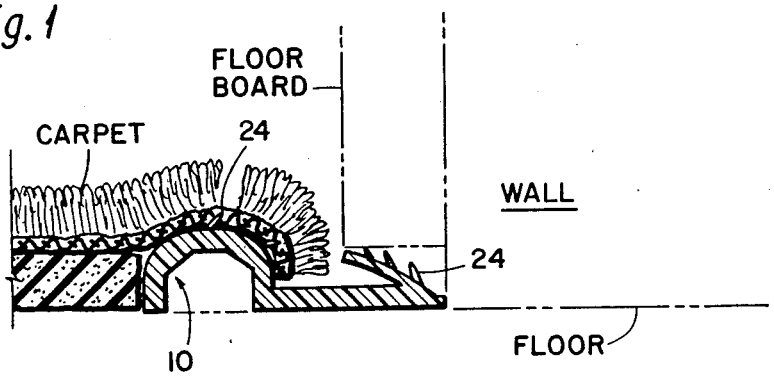
FIG. 2 is a cross-sectional view of the carpet fastener of FIG. 1 taken along line 2—2.
Figure 3:
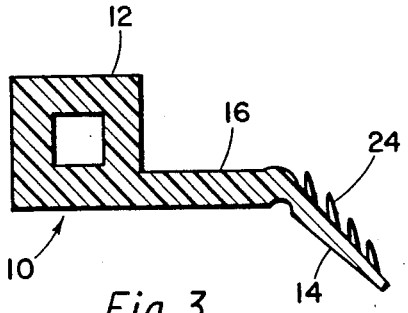
FIG. 3 is a cross-sectional view of an alternate embodiment of the carpet fastener of FIG. 1.

The height of the carpet-retaining portion 12 can vary according to need from flat/non-elevated, to humped or blocked (as shown in FIGS. 2 and 3). The length of the plateau portion 16 can vary according to need, especially according to thickness of carpet and face board.

Extending out from the body 10 is one continuous or a plurality of face board engaging portions 14 (as shown in FIG. 1). As shown in FIG. 2, the forward portion of the face board engaging portion includes a reverse angled extension 26 that can be compressed when inserted under the lower surface of the face board. The resiliency or "springiness" of the extension 26 can alone be used to retain the body 10 against the wall. However, preferably, the upper surface of the extension 26 includes a plurality of inclined protrusions or spikes 28.

An alternate embodiment of extension 26 is shown in FIG. 3, where the extension 26 is formed with a downward bend so that when the body 10 is forced against the face board, the extension 26 is "unbent" to force the spikes 28 into the underside of the face board.

In operation, the body 10 is cut to length, the edge of the expanse of carpet is folded over and secured to the carpet retaining portion 12. Thereafter, the face board engaging portion 14 is forced into the gap between the underside of the face board and the floor surface. Because of the extension 26, no nails or glue are needed to secure the edge of the carpet but could be used.

Figure 4:
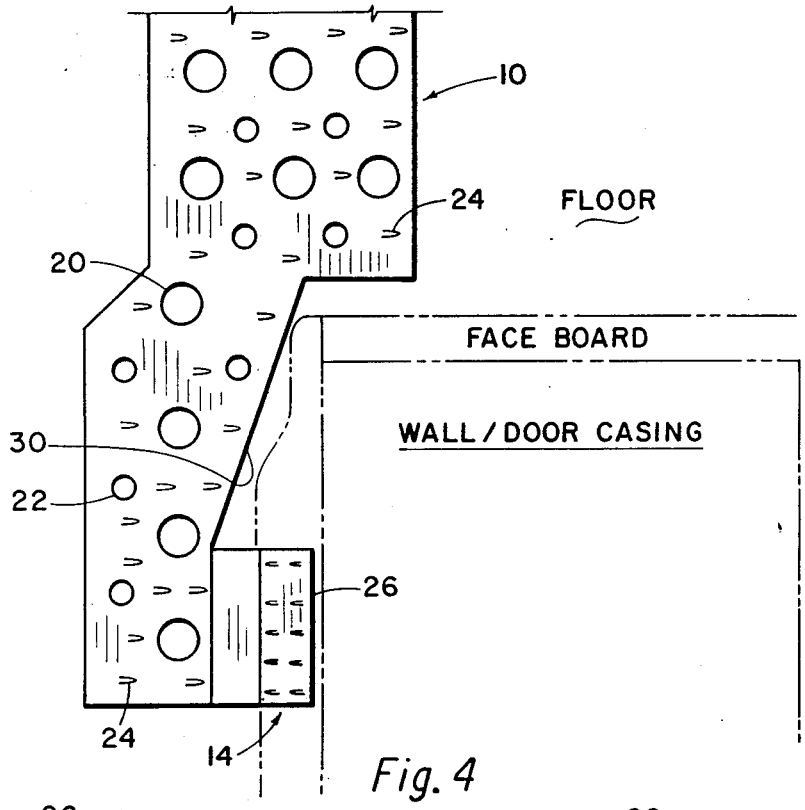
FIG. 4 is an overhead view of a carpet fastener of the present invention formed to secure a carpet edge across a doorway.

As shown in FIG. 4, the body 10 can be cut or specifically formed to be used across a doorway opening. In this use, a square, curved or inclined notch 30 is cut to provide a recess to receive a curved face board. Adjacent the notch 30, extends the extension 26 that is inserted under the face board.

Figure 5:
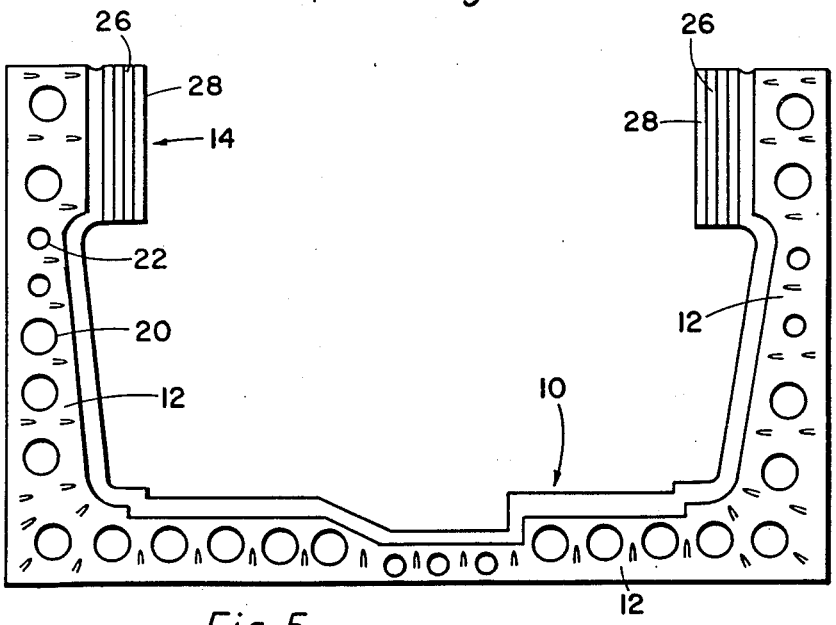
FIG. 5 is an overhead view of a carpet fastener of the present invention formed to secure a carpet edge around a doorway casing.

Further, as shown in FIG. 5, the body 10 can be cut or specifically formed to be used around a door casing. Specifically, the body 10 can be formed into a "U" shape with the extensions 26 opposed on an upper end of each arm of the "U". The body 10 is pushed towards the end of the door casing, which is received within the trough of the "U". The opposed extensions 26 are inserted under the face board on each side of the wall.

Whereas the present invention has been described in particular relation to the drawings attached hereto, it should be understood that other and further modifications can be made within the scope and spirit of the present invention.

What is claimed is:

1. A carpet fastener for securing an edge of an expanse of carpet against a vertical surface having a face board secured thereto, comprising:

an enlongated body having:

a carpet retaining portion including means for securing the carpet edge thereto, and a face board engaging portion comprising a reverse angled extension adapted to be compressed when inserted into a gap formed between the underside of the face board and a floor surface.

2. The carpet fastener of claim 1 wherein the body includes lateral cutting indentations.

3. The carpet fastener of claim 1 wherein the carpet retaining portion includes an enlarged mid-section formed so that the carpet edge is retained thereto.

4. The carpet fastener of claim 1 and including a plateau portion between the carpet retaining portion and the face board engaging portion.

5. The carpet fastener of claim 1 wherein the means for securing comprises a plurality of angled spikes.

6. The carpet fastener of claim 1 wherein an upper surface of the face board engaging portion includes protrusions for locking engagement with the underside of the face board.

7. The carpet fastener of claim 1 wherein the body is formed into a "U"-shape with opposed face board engaging portions on an outer portion of each arm of the "U".

8. The carpet fastener of claim 1 wherein the body includes notches between a series of face board engaging portions.

9. A carpet fastener for securing an edge of an expanse of carpet against a vertical surface having a face board secured thereto, comprising:

an elongated body having:

a carpet retaining portion including means for securing the carpet edge thereto, and a face board engaging portion comprising an extension bent downwardly from the horizontal and adapted to be compressed when inserted into a gap formed between the underside of the face board and a floor surface.

* * * * *